US011724266B2

(12) United States Patent
Qiu et al.

(10) Patent No.: US 11,724,266 B2
(45) Date of Patent: Aug. 15, 2023

(54) NOZZLE AND APPLICATOR SYSTEM COMPRISING THE SAME

(71) Applicant: NORDSON CORPORATION, Westlake, OH (US)

(72) Inventors: Peter Qiu, Minhang District (CN); Luo Haiyan, Yangpu District (CN)

(73) Assignee: Nordson Corporation, Westlake, OH (US)

( * ) Notice: Subject to any disclaimer, the term of this patent is extended or adjusted under 35 U.S.C. 154(b) by 647 days.

(21) Appl. No.: 16/608,824

(22) PCT Filed: May 9, 2018

(86) PCT No.: PCT/US2018/031728
§ 371 (c)(1),
(2) Date: Oct. 26, 2019

(87) PCT Pub. No.: WO2018/208876
PCT Pub. Date: Nov. 15, 2018

(65) Prior Publication Data

US 2020/0197958 A1 Jun. 25, 2020

(30) Foreign Application Priority Data

May 12, 2017 (CN) ..... 201710334374.0

(51) Int. Cl.
*B05C 5/02* (2006.01)
*B05B 1/04* (2006.01)
(Continued)

(52) U.S. Cl.
CPC ..... *B05B 1/044* (2013.01); *B05B 1/302* (2013.01); *B05B 9/002* (2013.01); *B05B 9/0413* (2013.01);
(Continued)

(58) Field of Classification Search
None
See application file for complete search history.

(56) References Cited

U.S. PATENT DOCUMENTS 3,303,972 A * 2/1967 Van Loben Sels ..... B05C 5/027 118/410
4,372,739 A * 2/1983 Vetter ..... B29C 48/31 425/467
(Continued)

FOREIGN PATENT DOCUMENTS

CN 1174523 A 2/1998
CN 1812844 A 8/2006
(Continued)

*Primary Examiner* — Binu Thomas
(74) *Attorney, Agent, or Firm* — BakerHostetler

(57) ABSTRACT

An applicator system for applying a material to a substrate is disclosed, the applicator system having a nozzle assembly (28) that includes a nozzle having a nozzle head (108). The nozzle assembly (28) also includes a baffle plate (101) including a cutout (144) that extends through the baffle plate (101), where the baffle plate (101) is received by the nozzle head (108) such that the nozzle head (108) and the baffle plate (101) define a cavity. The nozzle assembly (28) further includes a cover plate (102) attached to the nozzle head (108) such that the cover plate (102) secures the baffle plate (101) within the nozzle head (128), where an outlet passage is defined between the baffle plate (101) and the cover plate (102), the outlet passage being fluidly connected to the cavity through the cutout (144) of the baffle plate (101).

16 Claims, 13 Drawing Sheets

(51) Int. Cl.

| | |
|---|---|
| ***B05B 15/658*** | (2018.01) |
| ***B05B 1/30*** | (2006.01) |
| ***B05B 9/00*** | (2006.01) |
| ***B05B 9/04*** | (2006.01) |
| ***B05C 5/00*** | (2006.01) |

(52) U.S. Cl.
CPC ..... *B05B 15/658* (2018.02); *B05C 5/001* (2013.01); *B05C 5/0254* (2013.01); *B05C 5/0258* (2013.01)

(56) References Cited

U.S. PATENT DOCUMENTS 4,411,614 A * 10/1983 Feathers ..... B29C 48/305 425/467
4,656,845 A 4/1987 Fleissner
4,901,095 A * 2/1990 Perra, Jr. ..... B41J 3/4073 347/88
5,266,019 A * 11/1993 Farber ..... E04F 21/12 425/462
5,320,679 A * 6/1994 Derezinski ..... B29C 48/305 118/DIG. 2
5,329,964 A * 7/1994 Derezinski ..... B05C 5/0254 425/467
5,478,224 A * 12/1995 McGuffey ..... B05C 5/0258 425/72.1
5,525,376 A 6/1996 Leonard
6,352,424 B1 3/2002 Ulcej
6,540,831 B1 * 4/2003 Craine ..... B05C 5/0275 118/325
2007/0158476 A1 7/2007 Laidler et al.
2008/0134966 A1 6/2008 Luebbecke et al.
2008/0274223 A1 * 11/2008 Cloeren ..... B29C 48/2566 425/133.5
2009/0026230 A1 1/2009 Robinson et al.
2009/0188604 A1 * 7/2009 Ganzer ..... B05C 5/0291 156/324
2012/0031327 A1 2/2012 Love et al.
2012/0219657 A1 * 8/2012 Kondo ..... B05C 11/1002 425/382 R
2013/0095244 A1 4/2013 Maier et al.
2014/0000511 A1 * 1/2014 Wang ..... B05C 5/0254 118/211
2018/0375009 A1 12/2018 Conner et al.

FOREIGN PATENT DOCUMENTS

CN 201008812 Y 1/2008
CN 101244415 A 8/2008
CN 101352701 A 1/2009
CN 102947011 A 2/2013
CN 103052449 A 4/2013
CN 203540805 U 4/2014
CN 203540815 U 4/2014
CN 104526971 A 4/2015
JP 2001-029861 A 2/2001
JP 2007-125503 A 5/2007
JP 2007125503 A * 5/2007
JP 2007-167773 A 7/2007
JP 2008-073661 A 4/2008
JP 2009-148716 A 7/2009
JP 2015-020089 A 2/2015
JP 2016-196003 A 11/2016
KR 10-0806845 B1 2/2008
KR 10-2016-0137419 A 11/2016

* cited by examiner

NOZZLE AND APPLICATOR SYSTEM COMPRISING THE SAME

CROSS REFERENCE TO RELATED APPLICATIONS

The present application is a National Stage of International Patent App. No. PCT/US2018/031728, filed on May 9, 2018, which claims priority to Chinese Patent Application No. 201710334374.0, filed May 12, 2017, the entire disclosures of which are incorporated by reference into this application.

TECHNICAL FIELD

This disclosure generally relates to applicator systems for applying a material to a substrate and, more particularly to a nozzle assembly for use in an applicator system for applying a material to a substrate.

BACKGROUND

In the garment manufacturing field, applicator systems are commonly used to apply a material, such as a polyurethane (PUR) glue, to a fabric or cloth for binding pieces of the fabric or cloth together. When bonding pieces of fabric together, an applicator system is required that has the ability to spray a small amount of a material with a high degree of accuracy and precision. For example, the width of the desired strip of material to be applied to a fabric can have requirements of less than 8 mm in width and less than 0.2 mm in height. In many currently existing applicator systems, material is sprayed with low levels of accuracy and precision, which can result in the spraying of excessive amounts of material.

In addition to problems caused by excessive material spray, in many conventional applicator systems, material will continue to flow out of the applicator system for some time after the spraying operation has completed due to the effects of gravity. Due to the fact that during a conventional fabric bonding process an operator needs to repeatedly start and stop the applicator system, material will constantly flow out of the applicator system, leading to big ends, silk drawing, and other defects.

Therefore, there is a need for an applicator system that accurately sprays material and minimizes continued flowing of material out of the applicator system during a nonoperational state due to gravity.

SUMMARY

An embodiment of the present disclosure is a nozzle assembly for dispensing a material. The nozzle assembly includes a nozzle including a nozzle head, where the nozzle head has a body that includes a side surface and a nozzle recess extending into the body from the side surface. The nozzle assembly also includes a baffle plate including a cutout that extends through the baffle plate, where the baffle plate is received in the nozzle recess such that the nozzle head and the baffle plate define a cavity. The nozzle assembly further includes a cover plate attached to the nozzle head such that the cover plate secures the baffle plate within the nozzle recess, where an outlet passage is defined between the baffle plate and the cover plate, the outlet passage being fluidly connected to the cavity through the cutout of the baffle plate.

Another embodiment of the present disclosure is an applicator system for applying a material to a substrate. The applicator system includes a material supply for storing and heating the material, a pump fluidly connected to the material supply, and a valve for controlling operation of the pump. The applicator system also includes a nozzle assembly configured to receive the material from the pump and dispense the material onto the substrate. The nozzle assembly has a nozzle including a nozzle head and a baffle plate including a cutout that extends through the baffle plate, where the baffle plate is received by the nozzle head such that the nozzle head and the baffle plate define a fluid cavity. The nozzle assembly also includes a cover plate attached to the nozzle head such that the cover plate secures the baffle plate within the nozzle head, where an outlet passage is defined between the baffle plate and the cover plate, the outlet passage being fluidly connected to the fluid cavity through the cutout of the baffle plate.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
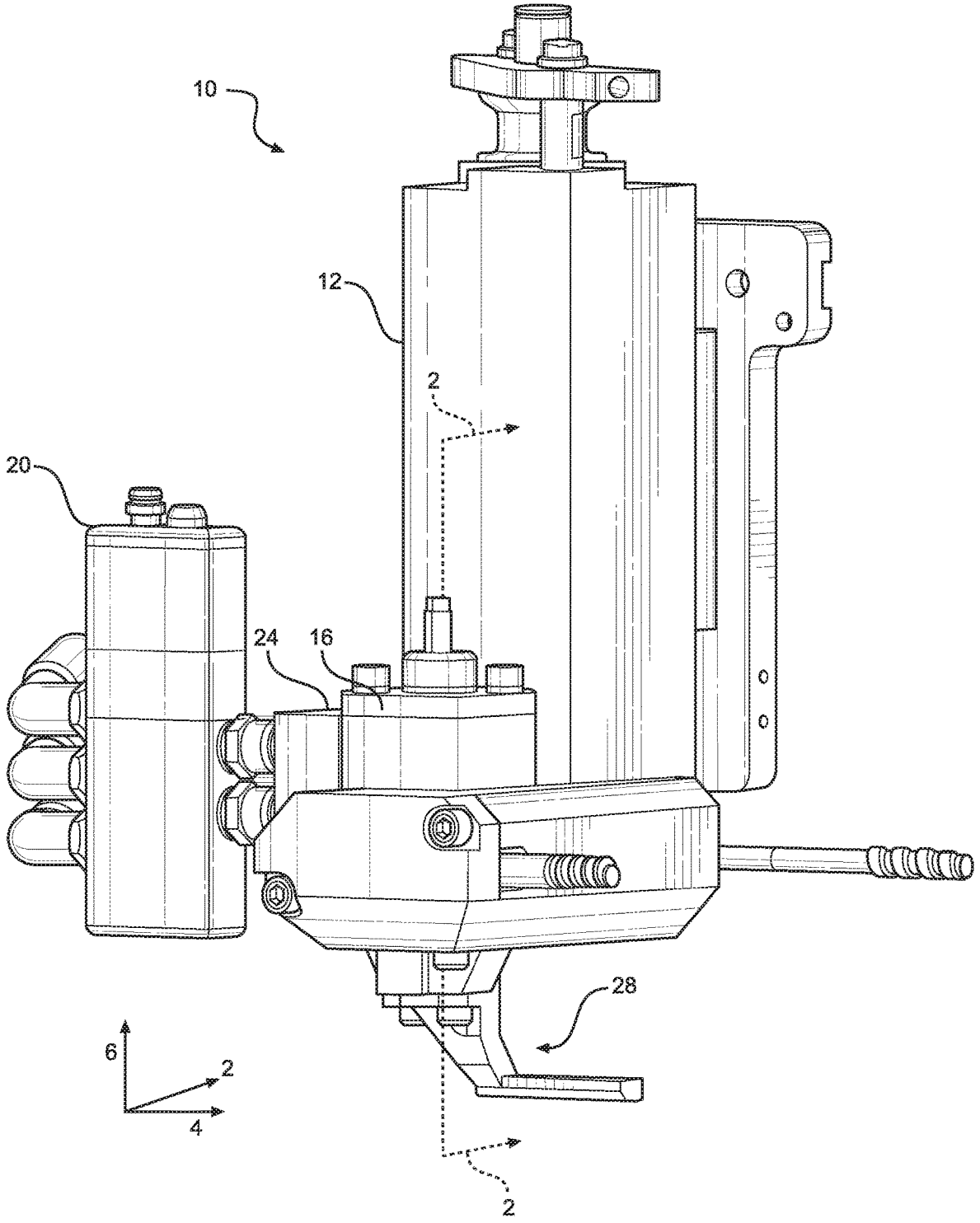
FIG. 1 is a perspective view of the an applicator system according to an embodiment of the present disclosure.

Described herein is an applicator system 10 and related nozzle assemblies 28, 28*a* for spraying a material onto a substrate. Certain terminology is used to describe the applicator system 10 in the following description for convenience only and is not limiting. The words "right," "left," "lower," and "upper" designate directions in the drawings to which reference is made. The words "inner" and "outer" refer to directions toward and away from, respectively, the geometric center of the description to describe the applicator system 10 and related parts thereof. The words "forward" and "rearward" refer to directions in a longitudinal direction 2 and a direction opposite the longitudinal direction 2 along the applicator system 10 and related parts thereof. The terminology includes the above-listed words, derivatives thereof, and words of similar import.

Unless otherwise specified herein, the terms "horizontal," "lateral," and "vertical" are used to describe the orthogonal directional components of various components of the applicator system 10, as designated by the longitudinal direction 2, lateral direction 4, and vertical direction 6. It should be appreciated that while the longitudinal and lateral directions 2 and 4 are illustrated as extending along a horizontal plane, and the vertical direction 6 extends in a direction that is normal to the horizontal plane, the planes that encompass the various directions may differ during use.

Figure 2:
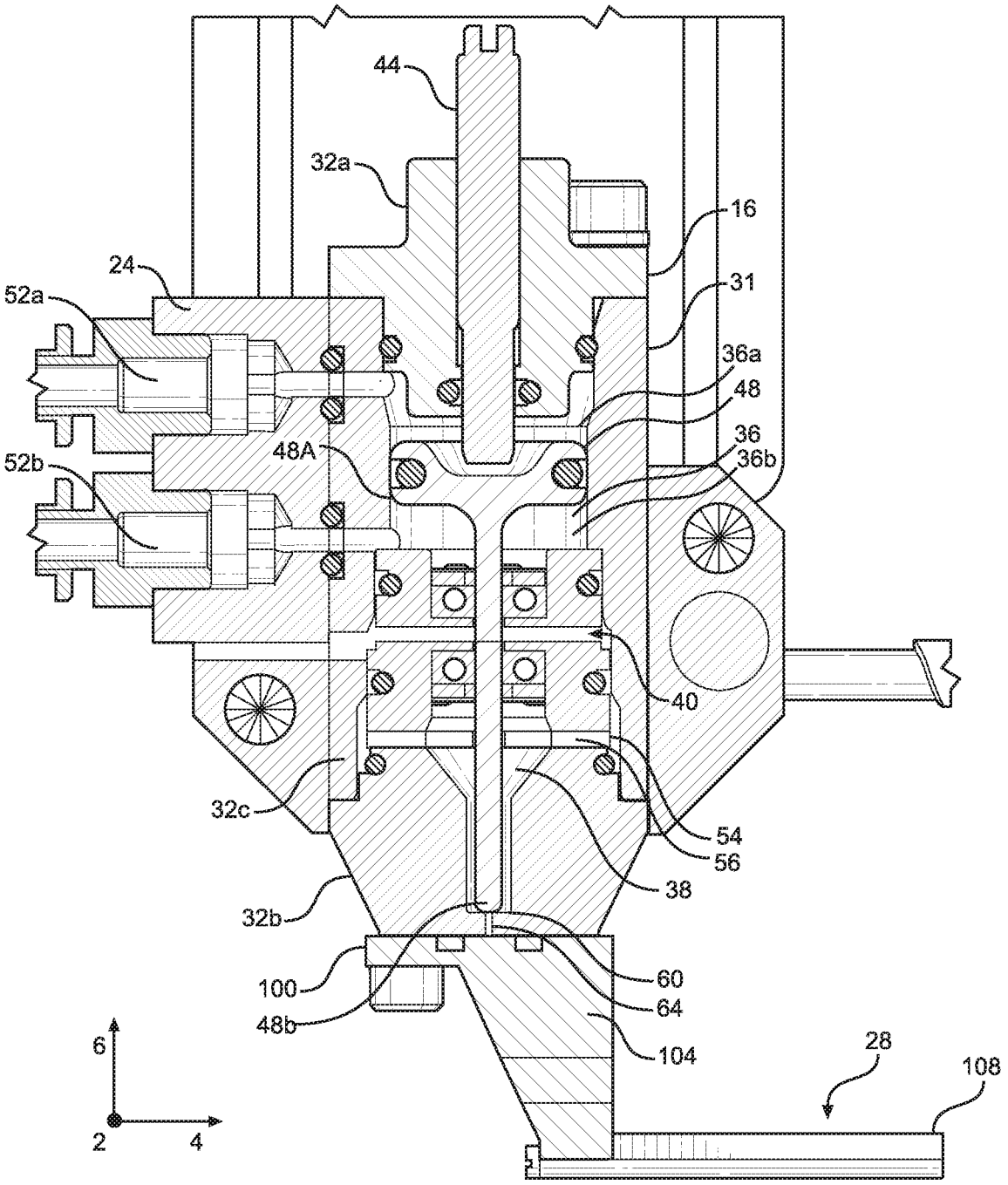
FIG. 2 is a cross-sectional view of the applicator system shown in FIG. 1, taken along line 2-2 shown in FIG. 1.
Figure 3A:
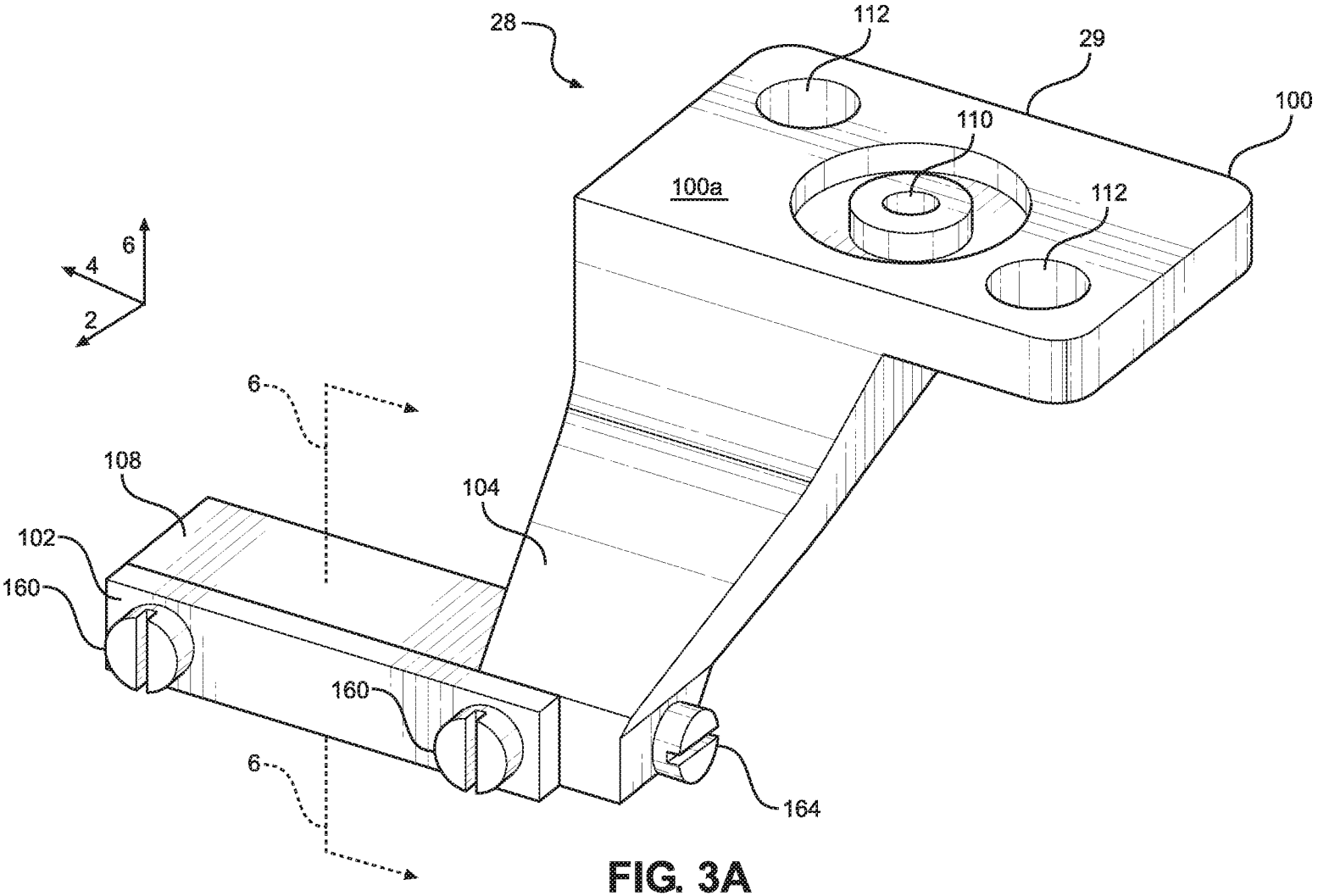
FIG. 3A is a perspective view of a nozzle assembly of the applicator system shown in FIG. 1.
Figure 3B:
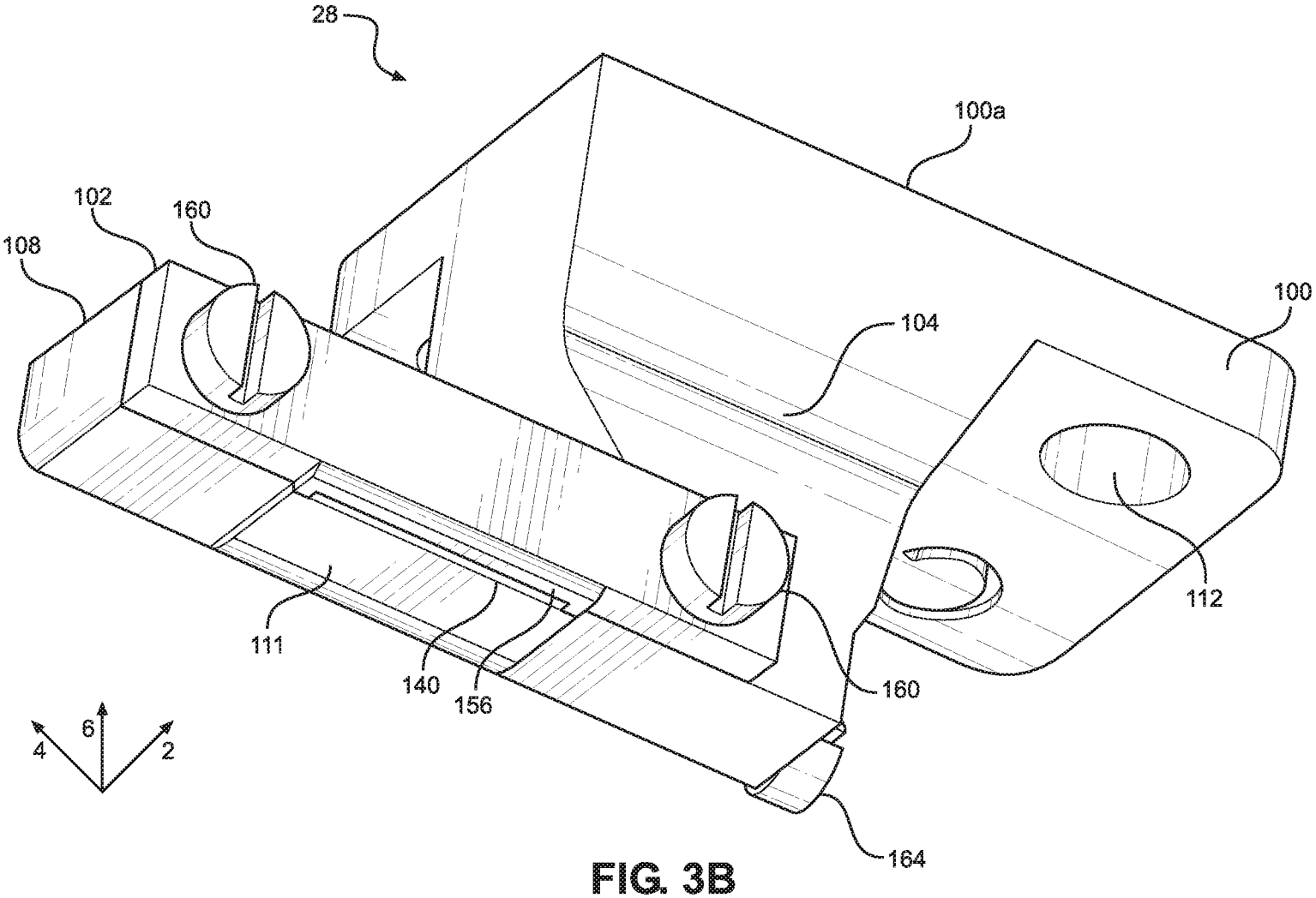
FIG. 3B is an alternative perspective view of a nozzle assembly shown in FIG. 3A.

Referring to FIGS. 1-2, the applicator system 10 comprises a material supply 12 for storing a supply of the material. The material can be received by material supply 12 in a prepackaged syringe (not shown), directly filled into a reservoir defined within the material supply 12, or pumped to the material supply 12 from an external supply (not shown) spaced from the applicator system 10. In one embodiment, the material is a glue, such as polyurethane (PUR) glue, though other materials are contemplated. The material supply 12 can be configured to melt and/or maintain the material at an elevated temperature while it remains within the material supply 12. In one embodiment, the material supply 12 can be designed to hold up to 300 cubic centimeters (cc) of material, though the material supply 12 can be larger or smaller as desired.

The applicator system 10 can also include a pump 16 fluidly connected to the material supply 12. The pump 16 can include an body 31 comprising a top component 32*a*, a middle component 32*b* attached to and positioned below the top component 32*a*, and a bottom component 32*c* attached to and positioned below the middle component 32*b*. Though shown as having three outer components, the body 31 of the pump 16 can alternatively define a monolithic body, or have any other number of components.

The body 31 of the pump 16 defines a substantially hollow body, such that an upper chamber 36 and a lower chamber 38 are defined within the body 31. A seal pack 40 is positioned within the body 31 and divides the interior of the body 31 into the upper and lower chambers 36, 38. The pump 16 also includes a firing pin 48 positioned within the body 31. The firing pin 48 defines an upper end 48*a* and a stem 48*b* that extends from the upper end 48*a* along the vertical direction 6. The upper end 48*a* is positioned within the upper chamber 36, while the stem 48*b* extends from the upper end 48*a* through the upper chamber 36, through the seal pack 40, and into the lower chamber 38.

In operation, the firing pin 48 is configured to reciprocate within the body 31 between a retracted and an extended position. This reciprocation can be caused by pressurized air that flows into the upper chamber 36 through first and second air paths 52*a*, 52*b*. Each of first and second air paths 52*a*, 52*b* can receive pressurized air from a valve 20, which is connected to the pump 16 through connector 24. The valve 20 can be a pneumatic valve, an electronic valve, or any other type of valve as desired. The upper end 48*a* of the firing pin 48 divides the upper chamber 36 into first and second portions 36*a*, 36*b*, where the first portion 36*a* can receive pressurized air from the first air path 52*a*, and the second portion 36*b* can receive pressurized air from the second air path 52*b*. When pressurized air flows through the first air path 52*a* and into the first portion 36*a* of the upper chamber 36, the firing pin 48 is driven downwards along the vertical direction 6 into an extended position. In contrast, when pressurized air flows through the second air path 52*b* and into the second portion 36*b* of the upper chamber 36, the firing pin 48 is driven upwards along the vertical direction 6 into a retracted position.

Continuing with FIGS. 1-2, the pump 16 includes a circumferential chamber 54 defined between an outer surface of the bottom component 32*c* of the body 31 and an inner surface of the middle component 32*b*. The circumferential chamber 54 is fluidly connected to the material supply 12, such that the circumferential chamber 54 is configured to receive material from the material supply 12 and allow the material to flow through the circumferential chamber 54 to radial holes 56 defined within the bottom component 32*c*. The material can then flow through the radial holes 56 to the lower chamber 38. In one embodiment, the radial holes 56 comprise four radial holes spaced equidistantly circumferentially around the bottom component 32*c*. However, it is contemplated that the radial holes 56 can comprise more or less holes, as well as holes having non-equidistant spacing.

When the firing pin 48 is in the retracted position, the stem 48*b* is spaced from a valve seat 60 defined by the bottom component 32*c* at the lower end of the lower chamber 38. In this position, material flows through the circumferential chamber 54, through the radial holes 56, and into the lower chamber 38. Then, when the firing pin 48 is transitioned into the extended position, the stem 48*b* of the firing pin 48 moves rapidly downward along the vertical direction 6 through the lower chamber 38 towards the valve seat 60. During this transition, the firing pin 48 causes an amount of the material within the lower chamber 38 to be discharged through an outlet channel 64 that extends from the lower chamber 38 at a lower end of the lower chamber 38. The outlet channel 64 is configured to guide this amount of the material from the lower chamber 38 to a nozzle assembly 28, 28*a* attached to the pump 16, which will be discussed further below. When in the extended position, the lower end of the stem 48*b* may contact the valve seat 60 and thus create a fluid seal between the lower chamber 38 and the outlet channel 64, or may be positioned slightly above the valve seat 60.

When firing pin 48 transitions from the retracted position to the extended position along the vertical direction 6, the firing pin 48 travels a distance that can be referred to as the stroke length. The required stroke length can vary between dispensing operations, types of materials dispensed, wear of internal parts over time, etc. As a result, the stroke length can be adjusted using the limiting rod 44, which extends through the top component 32*a* of the body 31 and into the first portion 36*a* of the upper chamber 36. When the firing pin 48 is in the retracted position, the upper end 48*a* can contact the lower end of the limiting rod 44, such that the limiting rod 44 controls the how far upwards the firing pin 48 moves in the retracted position. The limiting rod 44 can threadedly engage the top component 32*a*, such that rotation of the limiting rod 44 relative to the top component 32*a* moves the limiting rod 44 further into or out of the upper chamber 36, thus changing the maximum upward position of the firing pin 48 in the retracted position, and likewise the stroke length.

Continuing with FIGS. 3A-8, the nozzle assembly 28 can include a nozzle body 29. The nozzle body 29 can include an upper flange 100, an arm 104 extending from the upper flange 100, and a nozzle head 108 attached to the arm 104 opposite the upper flange 100. The upper flange 100 can include an inlet port 110 on its upper surface 100*a*, as well as two bores 112 that extend through the upper flange 100. When the applicator system 10 is fully assembled, the upper surface 100*a* contacts the pump 16 and the inlet port 110 can be in fluid communication with the outlet channel 64 of the pump 16, such that the nozzle assembly 28 receives the material from the pump 16 through the inlet port 110. The bores 112 can be configured to receive a bolt to secure the upper flange 100 to the pump 16. However, it should be appreciated that the upper flange 100 can include more or less bores 112 than depicted. Alternatively, the nozzle assembly 28 can be attached to the pump 16 through alternative means, such as through snap fit engagement, engagement via dovetail slots, clamping, etc.

The arm 104 is shown as extending downwards from the upper flange 100 along a direction that is angularly offset from the vertical direction 6. Though one particular angular orientation between the arm 104 and the upper flange 100 is shown, in other embodiments the arm 104 can extend downward from the upper flange 100 along the vertical direction 6, or at other angular offsets from the vertical direction 6. The nozzle head 108 extends substantially horizontal away from the arm 104, and defines the portion of the nozzle assembly 28 through which material is dispensed onto a substrate. The nozzle assembly 28 can include a baffle plate 101 and a cover plate 102 attached to the nozzle head 108, which will be discussed further below. The nozzle body 29 can be monolithic, and can be formed through casting, injection molding, etc.

The nozzle head 108 can have an upper surface 108*a*, a lower surface 108*b* opposite the upper surface 108*a* along the vertical direction 6, a first side surface 108*c*, a second side surface 108*d* opposite the first side surface 108*c* along the lateral direction 4, a front surface 108*e*, and a rear surface 108*f* opposite the front surface 108*e* along the longitudinal direction 2. In operation, each of the surfaces 108*a*-108*f* can be generically referred to as a "side surface." Due to the shown configuration of the surfaces 108*a*-108*f*, the nozzle head 108 can be substantially shaped as a rectangular prism. The arm 104 includes a passage 116 that extends internally through the arm 104 from the inlet port 110 to a transfer passage 120 that extends through the nozzle head 108. At the end of the passage 116, the nozzle head 108 can also include a flush bore 122 that extends from the passage 116 to the second side surface 108*d*. The flush bore 122 allows user access to the interior passages of the nozzle body 29 for cleaning or flushing during periods the applicator system 10 is not operational. When the nozzle assembly 28 is fully assembled, a plug 164 can at least partially extend into the flush bore 122 to seal the flush bore 122 during operation. The plug 164 can threadedly engage the nozzle head 108 to seal the flush bore 122, though it should be appreciated that the plug 164 can engage the nozzle head 108 through other means. Though shown as extending from the passage 116 to the second side surface 108*d*, the flush bore 122 can alternatively extend from the passage 116 to any of the surfaces 108*a*-108*f* as desired.

Figure 6:
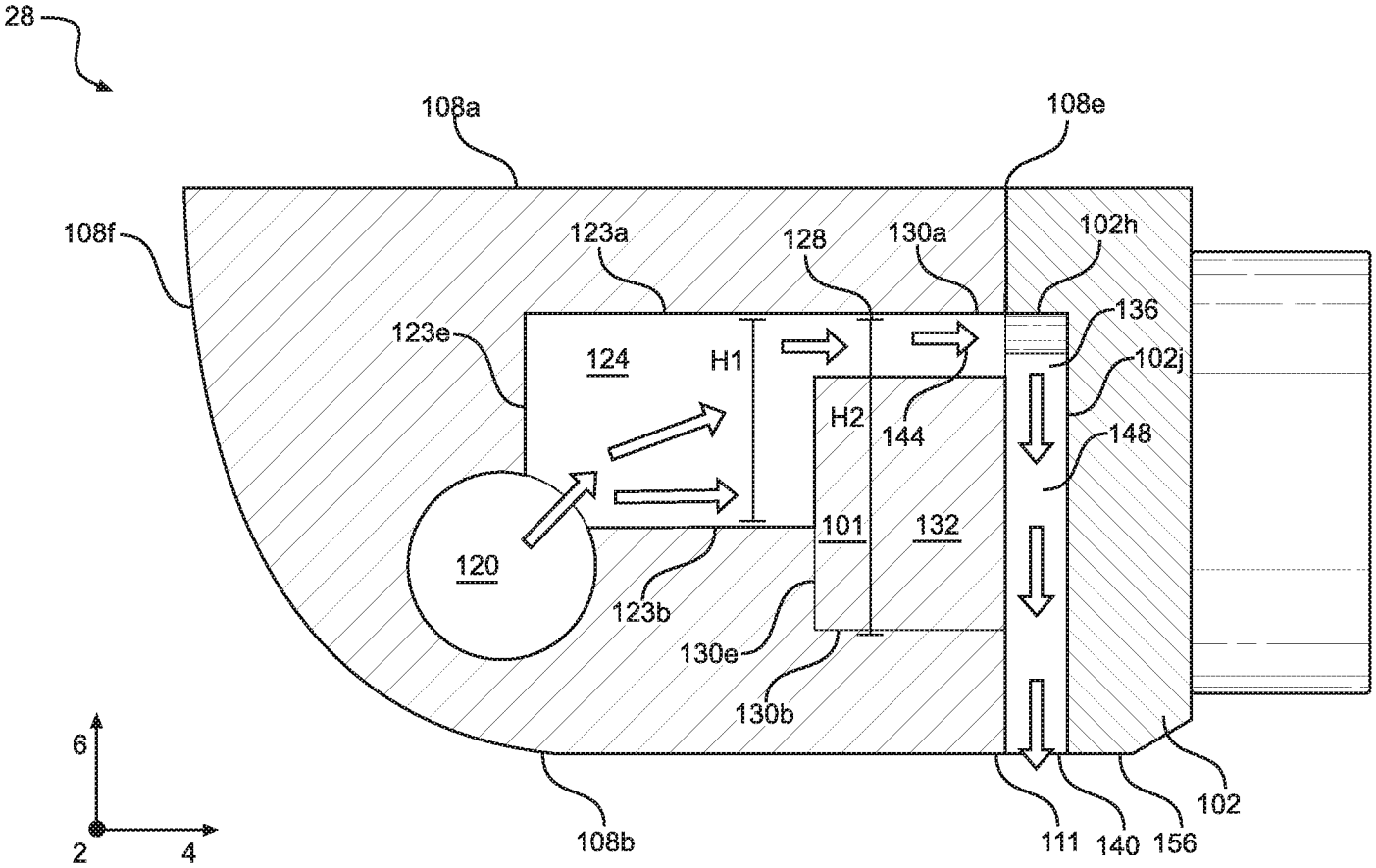
FIG. 6 is a cross-sectional view of the nozzle assembly shown in FIG. 3A, taken along line 6-6 shown in FIG. 3A.
Figure 7A:
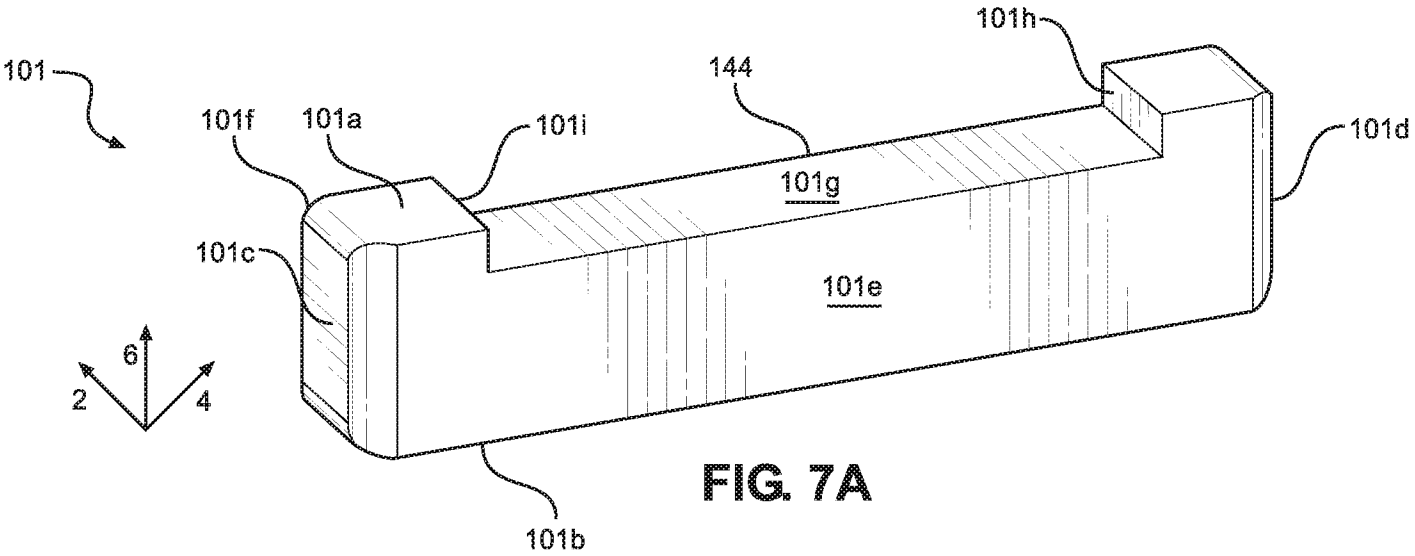
FIG. 7A is a perspective view of a baffle plate of the nozzle assembly shown in FIG. 3A.
Figure 7B:
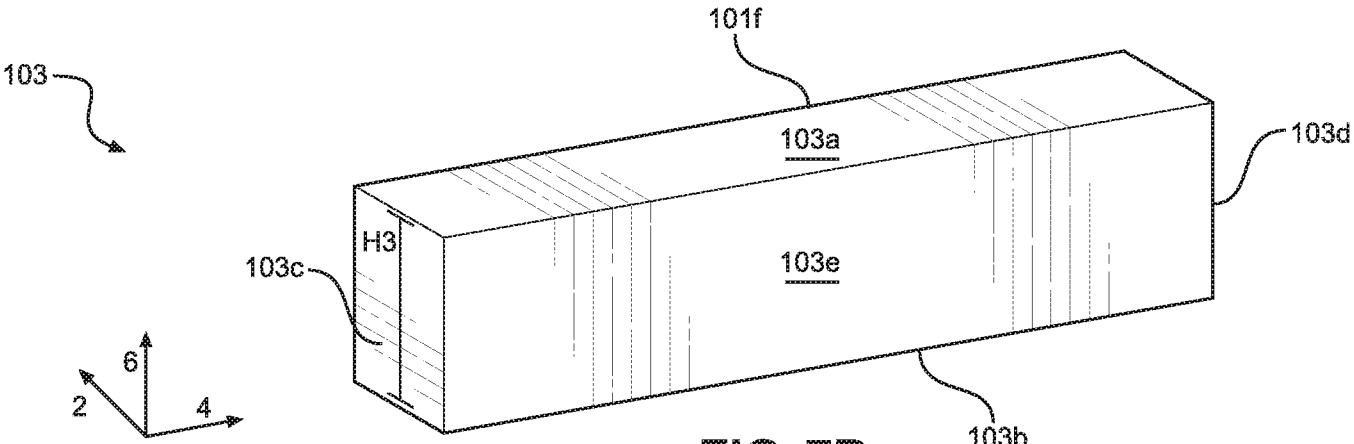
FIG. 7B is a perspective view of an alternative baffle plate for use in the nozzle assembly shown in FIG. 3A.

Referring to FIGS. 6-7A, the nozzle head 108 can also include a nozzle recess 132 extending from the front surface 108*e* into the nozzle head 108. The nozzle recess 132 can be defined by an upper surface 130*a* that extends inward from the front surface 108*e* of the nozzle head 108, a lower surface 130*b* that extends inward from the front surface 108*e* opposite the upper surface 130*a*, a first side surface 130*c* that extends inward from the front surface 108*e* and extends from the upper surface 130*a* to the lower surface 130*b*, and a second side surface 130*d* that extends inward from the front surface 108*e* opposite the first side surface 130*c*, as well as from the upper surface 130*a* to the lower surface 130*b*. The baffle plate 101 can have an upper surface 101*a*, a lower surface 101*b* opposite the upper surface 101*a* along the vertical direction 6, a first side surface 101*c*, a second side surface 101*d* opposite the first side surface 101*c* along the lateral direction 4, a front surface 101*e*, and a rear surface 101*f* opposite the front surface 101*e* along the longitudinal direction 2. As such, the baffle plate 101 can have a substantially rectangular shape. The nozzle recess 132 can be sized to receive the baffle plate 101 such that the shape of the nozzle recess 132 and the shape of the baffle plate 101 generally conform to each other. The baffle plate 101 can be suitably installed within the nozzle head 108 by pressing the baffle plate 101 within the nozzle recess 132. When the baffle plate 101 is fully within the nozzle recess 132, the front surface 101*e* of the baffle plate 101 can be substantially coplanar with the front surface 108*e* of the nozzle head 108, though other configurations are envisioned. To help secure the baffle plate 101 within the nozzle recess 132, any of the upper, lower, first side, or second side surfaces 130*a*-130*d* can have an increased roughness or texture for engaging the baffle plate 101. Additionally or alternatively, any of the upper, lower, first side, or second side surfaces 101*a*-101*d* of the baffle plate 101 can have an increased roughness or texture for engaging the surfaces 130*a*-130*d* that define the nozzle recess 132. Though not shown, it is contemplated that the nozzle assembly 28 can include sealing elements around the baffle plate 101 that provide a fluid seal between the nozzle head 108 and the baffle plate 101.

The baffle plate 101 can also include a cutout 144 that extends into the baffle plate 101 from the upper surface 101*a*, as well as from the front surface 101*e* to the rear surface 101*f*. The cutout 144 can be defined by a first cutout surface 101*i* that extends downward from the upper surface 101*a* along the vertical direction 6, a second cutout surface 101*h* that extends downward from the upper surface 101*a* along the vertical direction 6, and a third cutout surface 101*g* that extends from the first cutout surface 101*i* to the second cutout surface 101*h*. As a result, the cutout 144 can be substantially rectangular. As depicted, the third cutout surface 101*g* is positioned vertically between the upper surface 101*a* and the lower surface 101*b*, and extends substantially parallel to the lower surface 101*b*. However, other configurations of the third cutout surface 101*g* are contemplated. In one embodiment, the third cutout surface 101*g* can be sloped towards or away from either of the front or rear surfaces 101*e*, 101*f*. Additionally, it should be appreciated that the cutout 144 may not be rectangular and can define another shape, and likewise that the first, second, and third cutout surfaces 101*g*, 101*h*, 101*i* are alternatively configured. The baffle plate 101 can be formed from a variety of methods, such as stamping, casting, etc., and along with the nozzle head 108 can be formed from a material such as an aluminum alloy.

Figure 8:
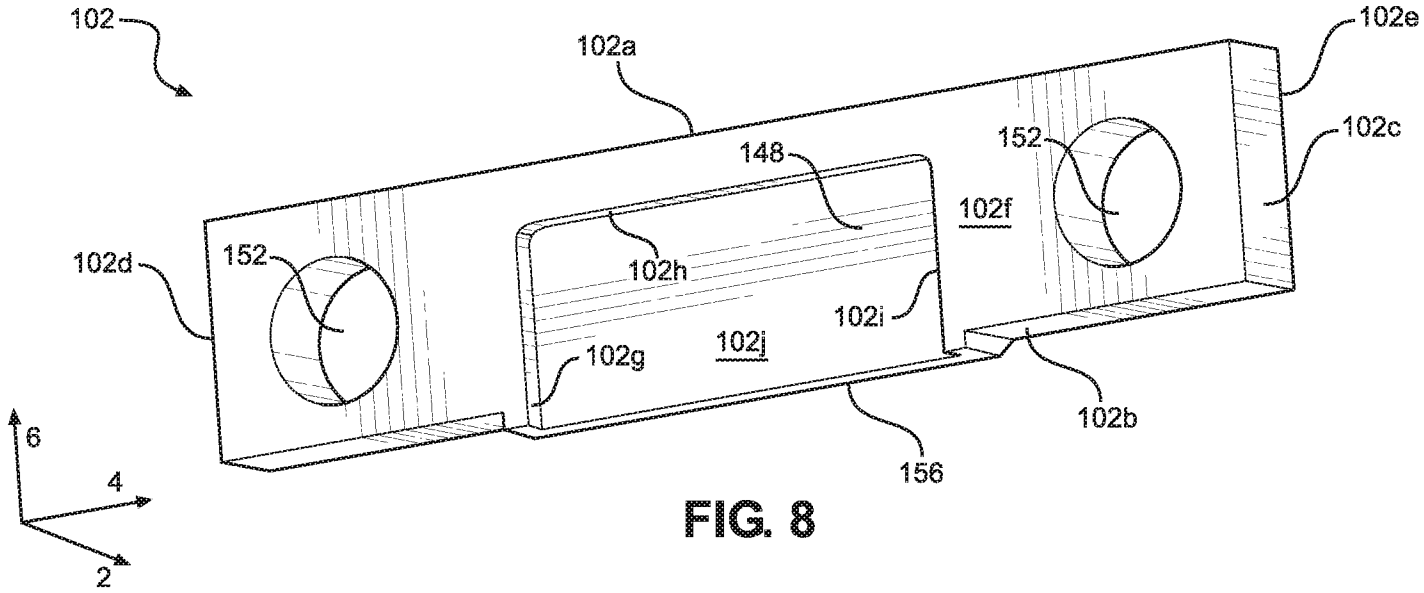
FIG. 8 is a perspective view of a cover plate of the nozzle assembly shown in FIG. 3A.
Figure 9A:
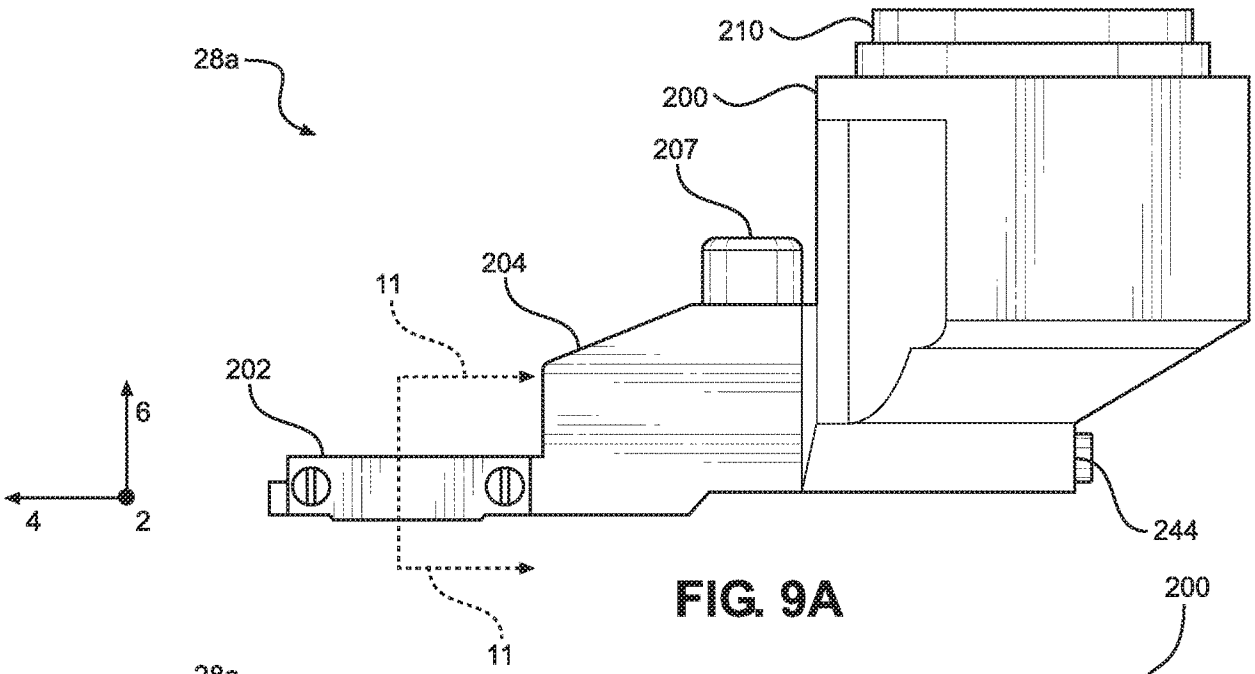
FIG. 9A is a side view of a nozzle assembly according to another embodiment of the present disclosure.
Figure 9B:
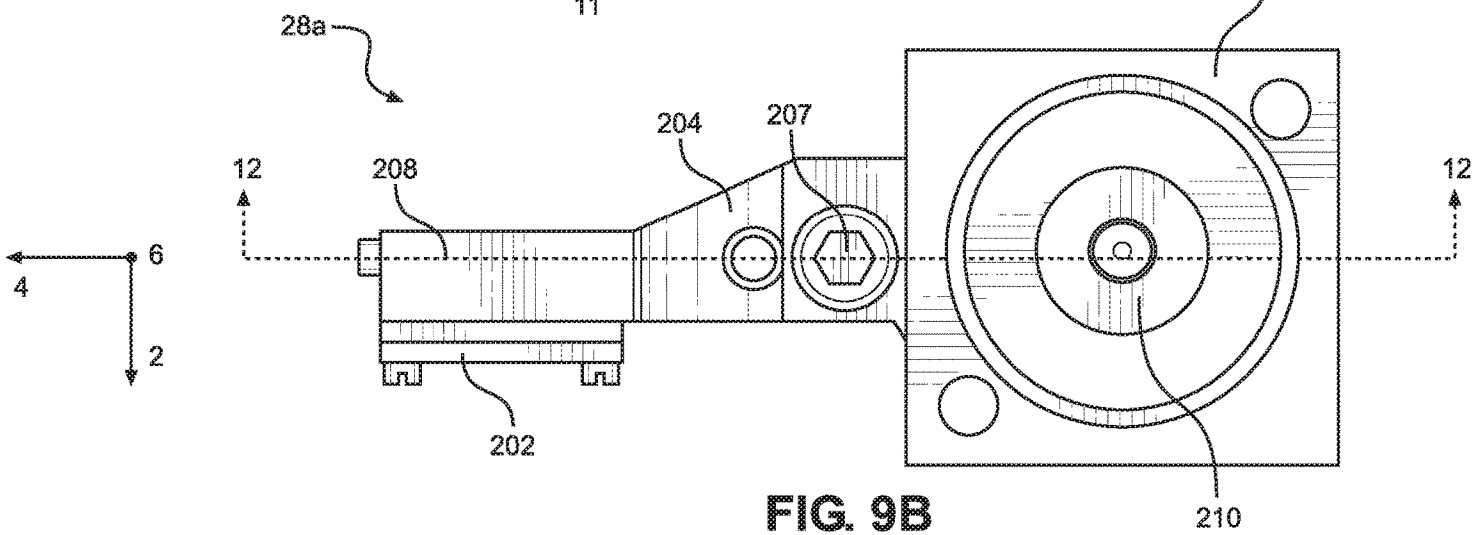
FIG. 9B is a top view of the nozzle assembly shown in FIG. 9A.
Figure 10:
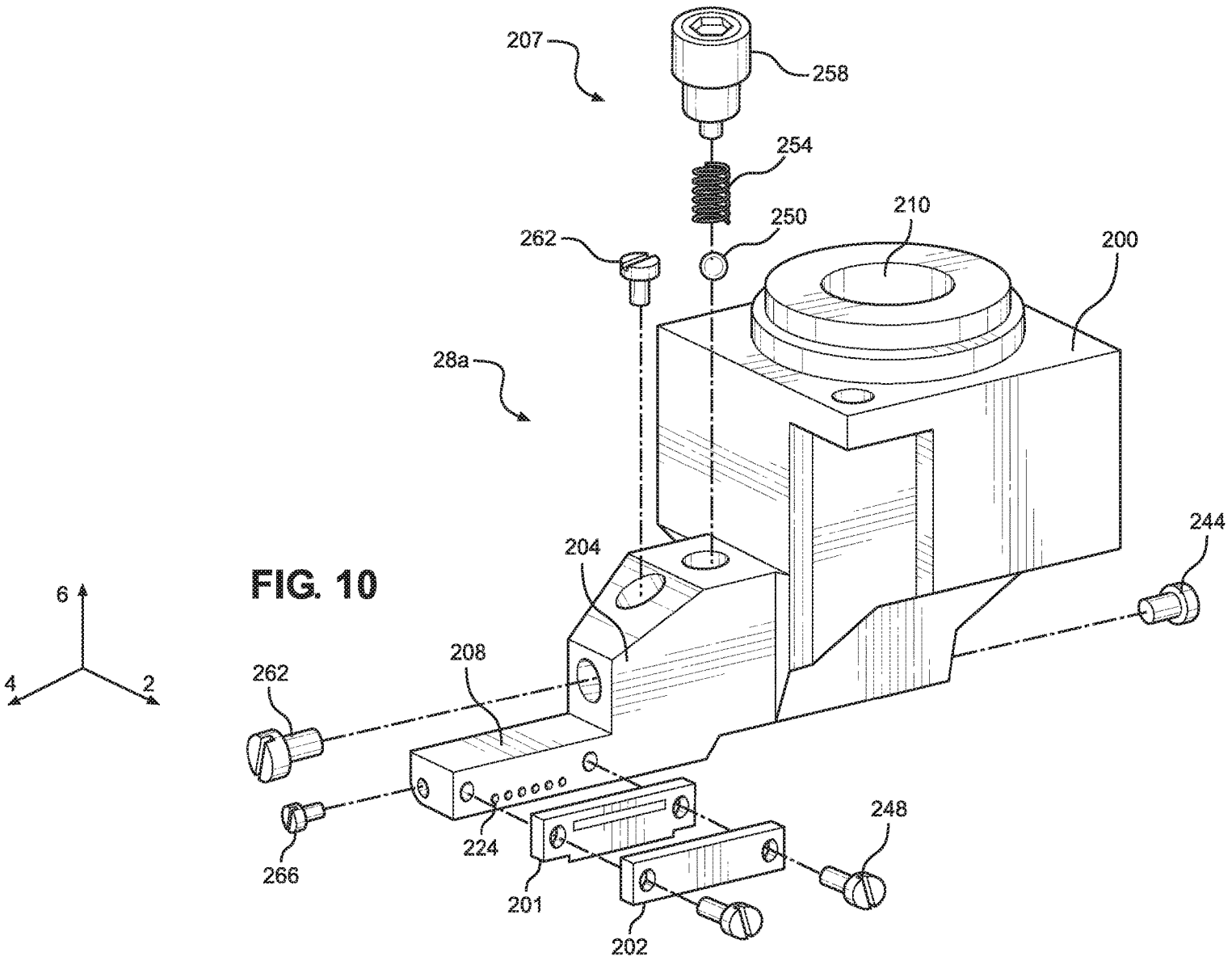
FIG. 10 is an exploded view of the nozzle assembly shown in FIG. 9A.
Figure 11:
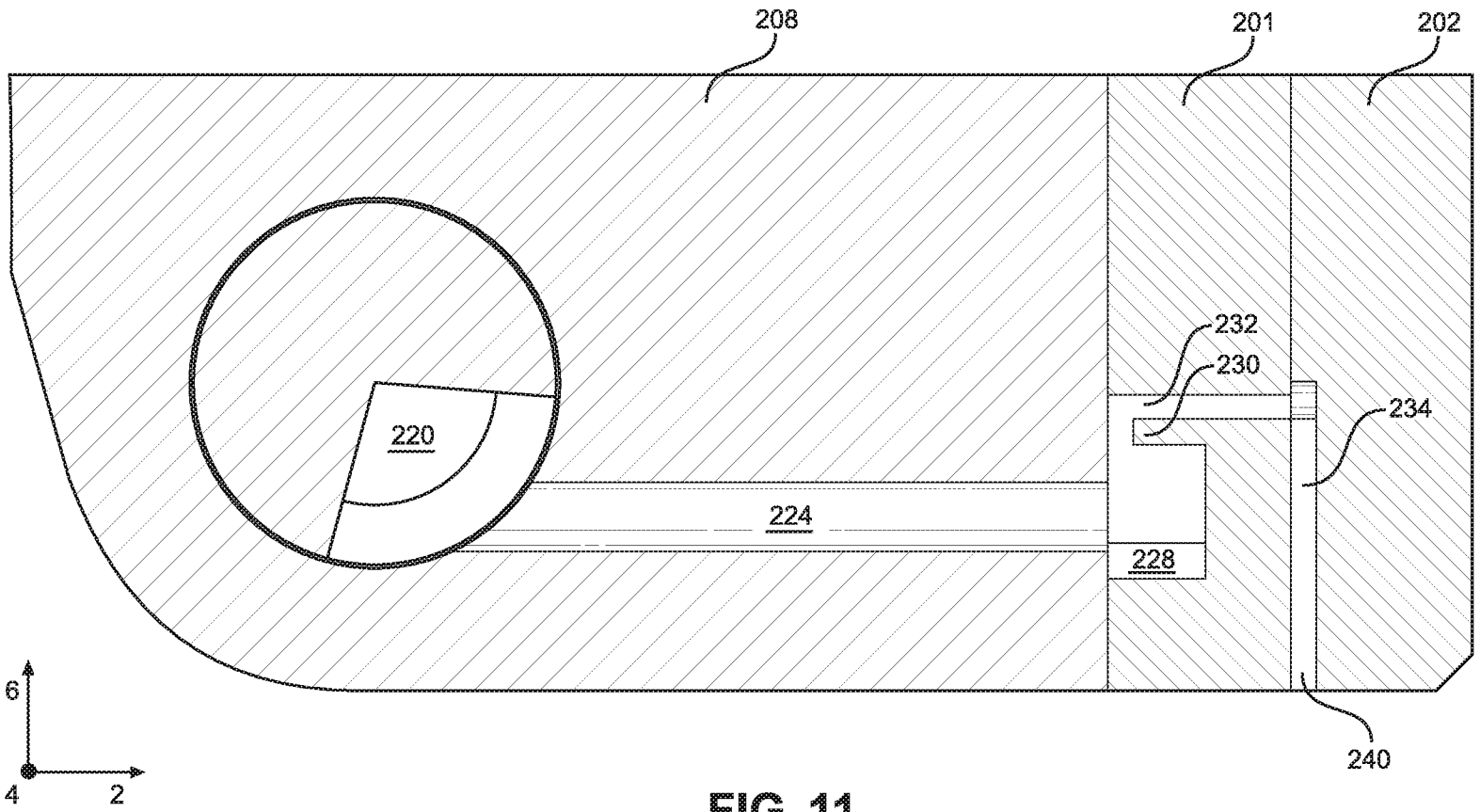
FIG. 11 is a cross-sectional view of the nozzle assembly shown in FIG. 9A, taken along line 11-11 shown in FIG. 9A.
Figure 12:
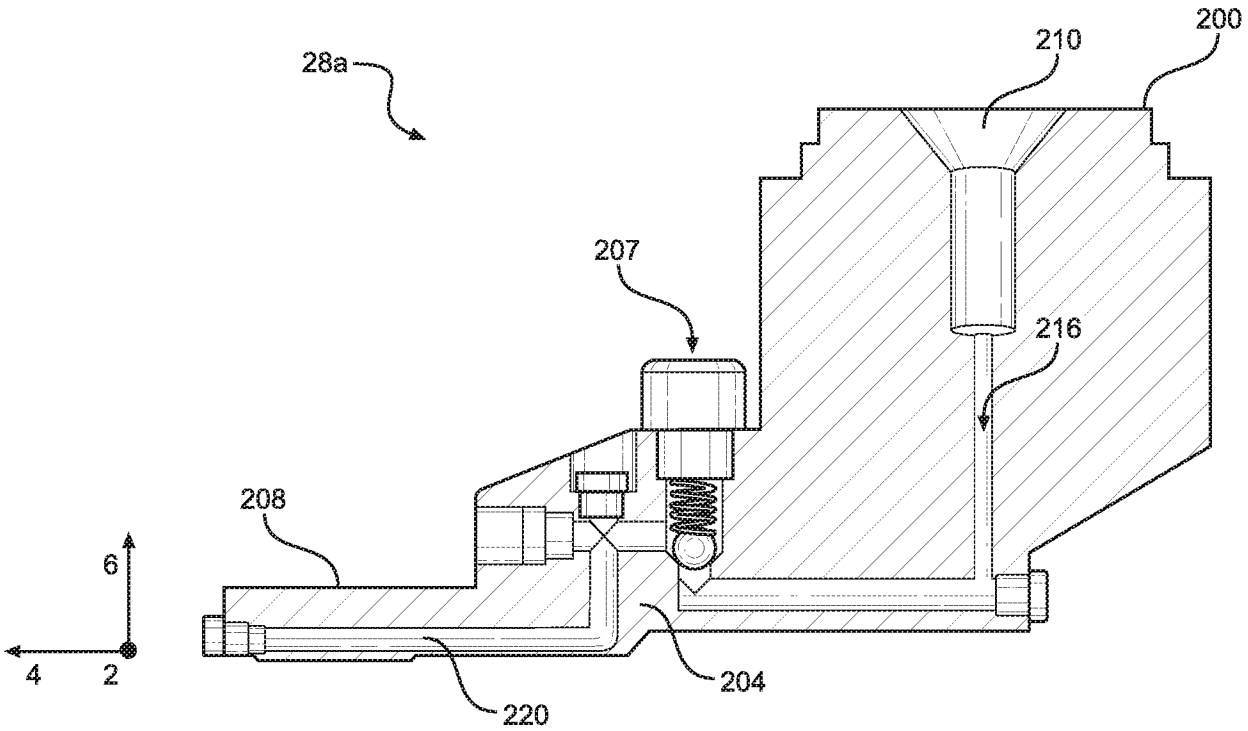
FIG. 12 is a cross-sectional view of the nozzle assembly shown in FIG. 9A, taken along line 12-12 shown in FIG. 9B.

Referring now to FIGS. 6 and 8, a cover plate 102 can be attached to the nozzle head 108 to secure the baffle plate 101 within the nozzle recess 132. The cover plate 102 can have an upper surface 102*a*, a bottom surface 102*b* opposite the upper surface 102*a* along the vertical direction 6, a first side surface 101*c*, a second side surface 101*d* opposite the first side surface 101*c* along the lateral direction 4, a front surface 101*e*, and a rear surface 101*f* opposite the front surface 101*e* along the longitudinal direction 2. As a result, the cover plate 102 can have a substantially rectangular shape. The cover plate 102 can further include an extension 156 that extends from the bottom surface 102*b* along the vertical direction 6, as well as from the rear surface 102*f* towards the front surface 102*e*. The extension 156 may extend partially towards the front surface 102*e*, or completely to the front surface 102*e*. As depicted, the extension 156 is spaced from the first and second side surfaces 102*c*, 102*d*, though it is contemplated that the extension 156 can extend to one or both of the first and second side surfaces 102*c*, 102*d*. Additionally, the cover plate 102 can include a recess 148 that extends into the cover plate 102 from the rear surface 102*f* The cover plate 102 can include an inner recess surface 102*j* that can extend along the lateral and vertical directions 4, 6, and is between and substantially parallel to the front and rear surfaces 102*e*, 102*f* The cover plates 102 can further include a first recess surface 102*g* that extends from the rear surface 102*f* to the inner recess surface 102*j*, a third recess surface 102*i* opposite the first recess surface 102*g* that extends from the rear surface 102*f* to the inner recess surface 102*j*, and a second recess surface 102*h* that extends from the rear surface 102*f* to the inner recess surface 102*j*, as well as from the first recess surface 102*g* to the third recess surface 102*i*. The first, second, third, and inner recess surfaces 102*g*-102*j* define the recess 148. To attach the cover plate 102 to the nozzle head 108, bores 152 can extend through the cover plate 102 that are configured to receive screws 160, which can threadingly engage corresponding bores 109 defined in the nozzle head 108. However, other means over engaging the cover plate 102 and the nozzle head 108 are contemplated, such as snap fit engagement, clamping, slot and groove engagement, etc.

Figure 4:
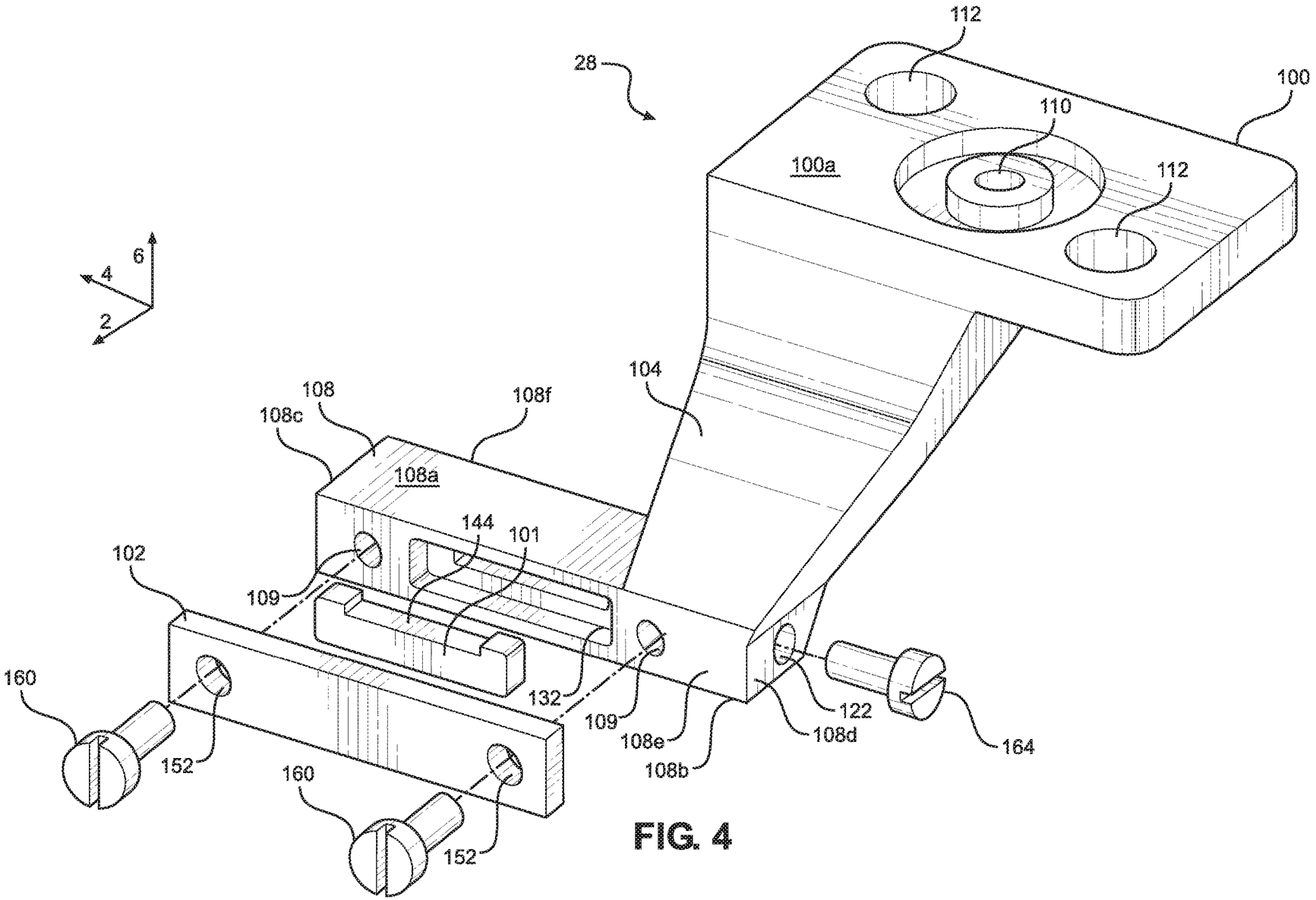
FIG. 4 is an exploded view of the nozzle assembly shown in FIG. 3A.
Figure 5:
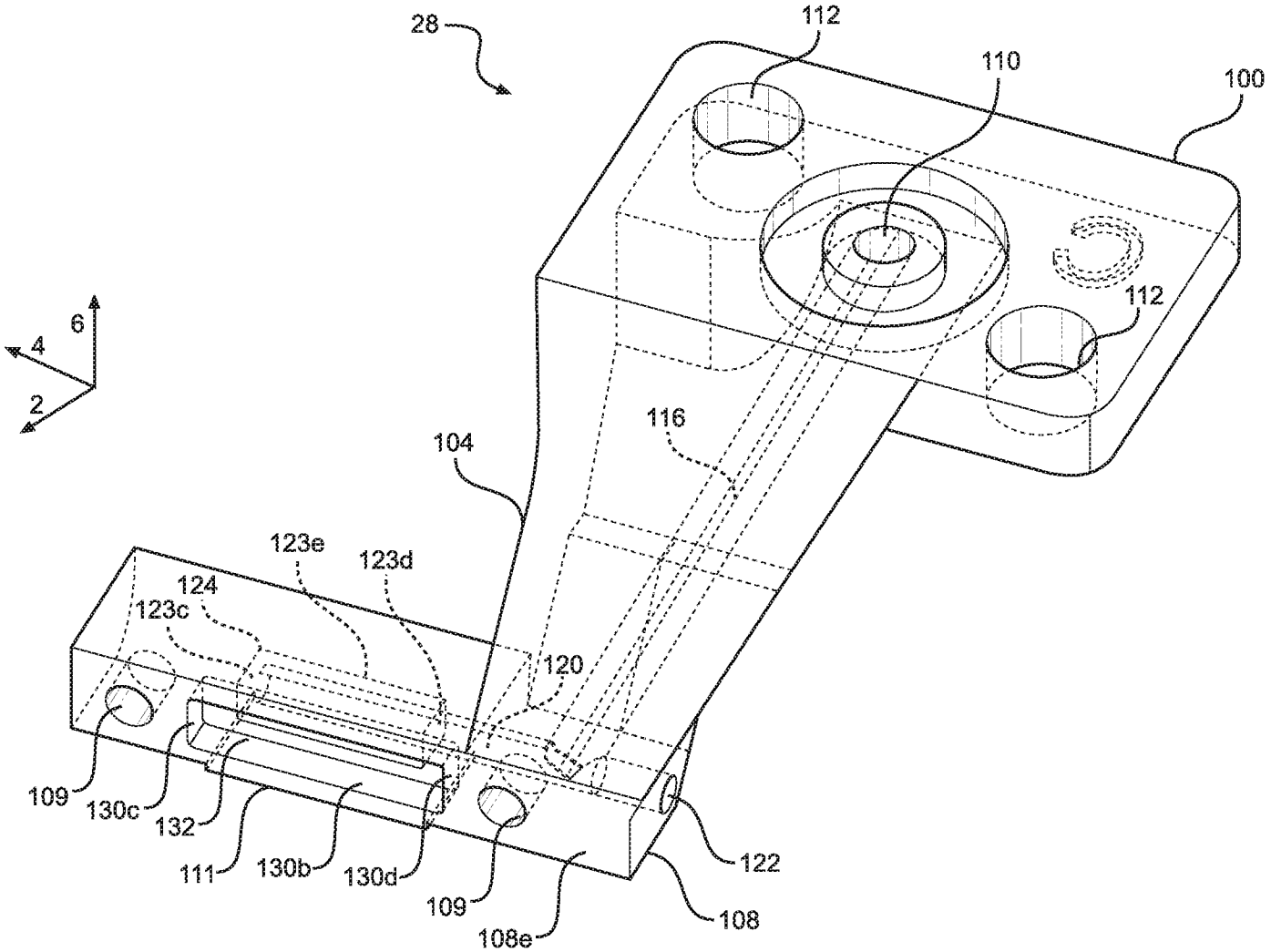
FIG. 5 is a perspective view of a nozzle of the nozzle assembly shown in FIG. 3A, with the nozzle rendered transparent.

Referring to FIGS. 4-6, the transfer passage 120 can extend through the nozzle head 108 along the lateral direction 4. Though the transfer passage 120 is shown having a substantially cylindrical shape, the transfer passage 120 can define other shapes as desired. The nozzle head 108 can further define a fluid cavity 124 in fluid communication with the transfer passage 120. The fluid cavity 124 can be substantially rectangular, and can be defined by an upper surface 123*a*, a lower surface 123*b* opposite the upper surface 123*a* along the vertical direction 6, a first side surface 123*c*, a second side surface 123*d* opposite the first side surface 123*c* along the lateral direction 4, and a rear surface 123*e*. The fluid cavity 124 is shown as having a particular position relative to the nozzle recess 132. In the depicted embodiment, the upper surface 123*a* of the fluid cavity 124 is substantially coplanar with the upper surface 130*a* of the nozzle recess 132, and the lower surface 123*b* of the fluid cavity 124 is shown as positioned above the lower surface 130*b* of the nozzle recess 132. Also, the first and second side surfaces 130*c*, 130*d* of the nozzle recess 132 are shown as spaced laterally outwards with respect to the first and second side surfaces 123*c*, 123*d* of the fluid cavity 124. However, it should be appreciated that these surfaces can have various other relative configurations. The fluid cavity 124 can define a first height $H_1$ measured along the vertical direction 6, while the nozzle recess 132 can define a second height $H_2$ measured along the vertical direction 6 that is greater than the first height $H_1$.

When the baffle plate 101 is fully installed within the nozzle recess 132 of the nozzle head 108, the rear surface 101*f* of the baffle plate 101 partially defines the fluid cavity 124, along with the surfaces 123*a*-123*e*. The cutout 144 of the baffle plate 101, along with the upper surface 130*a*, defines a passage 128 that extends from the upper end of the fluid cavity 124 to an outlet passage 136. The cutout 144, and thus the outlet passage 136, can define a height measured along the vertical direction 6 that is suitable for a particular dispensing operation. Because the baffle plate 101 can be easily replaced, an operator can select a baffle plate 101 from a plurality of baffle plates 101 having a particular cutout 144 height.

When the cover plate 102 is secured to the nozzle head 108 such that the cover plate 102 secures the baffle plate 101 within the nozzle recess 132, an outlet passage 136 can be defined between the baffle plate 101 and the cover plate 102, where the outlet passage 136 is fluidly connected to the fluid cavity 124 through the passage 128, and thus the cutout 144 of the baffle plate 101. The outlet passage 136 can define a short length along the longitudinal direction 2, but a comparatively larger width along the lateral direction 4. The outlet passage 136 can be partially defined by the recess 148 of the cover plate 102. The outlet passage 136 extends along the vertical direction 6 from the passage 128 to the outlet 140, which is defined at the lower end of the nozzle assembly 28 and through which material is dispensed from the nozzle assembly 28 and onto a substrate. The outlet 140 can be configured as a narrow slot defined between the cover plate 102 and the nozzle head 108. However, the outlet 140 can be alternatively configured as desired. Adjacent the outlet 140, the extension 156 of the cover plate 102 extends downwards along the vertical direction 6. Similarly, the nozzle head 108 can define an extension 111 that extends downward from the nozzle head 108 along the vertical direction 6 adjacent to the outlet 140. The extension 111 can define a similar width as the extension 156 along the lateral direction 4, though the extension 111 and the extension 156 can be differently shaped. The function of the extensions 111, 156 will be discussed further below.

In operation, the inlet port 110 receives an amount of material dispensed from the pump 16. The material then flows through the inlet port 110, through the passage 116 defined within the arm 104, and to the transfer passage 120. From the transfer passage 120, the material flows into the fluid cavity 124 formed between the baffle plate 101 and the body of the nozzle head 108. Over time, the material begins to fill the fluid cavity 124, until the material reaches a level above the third cutout surface 101*g* of the cutout 144. At this point, the material flows through the passage 128 formed by the cutout 144 and the nozzle head 108 and to the outlet passage 136 formed between the nozzle head 108 and the cover plate 102. Then, the material flows downwardly through the outlet passage 136, which includes the recess 148 of the cover plate 102, through the outlet 140, and onto a substrate. The flow of material through the various passages of the nozzle head 108 is shown by the thick arrows in FIG. 6. The extensions 111, 156 of the nozzle head 108 and cover plate 102, respectively, function as scraping lips during an application process. In other words, the extensions 111, 156 can press on the substrate to which the material is being applied during an application process so as to more accurately apply the material to the substrate With reference to FIG. 7B, another embodiment of a baffle plate 103 usable with the nozzle assembly 28 is shown. The baffle plate 103 can have an upper surface 103*a*, a lower surface 103*b* opposite the upper surface 103*a* along the vertical direction 6, a first side surface 103*c*, a second side surface 103*d* opposite the first side surface 103*c* along the lateral direction 4, a front surface 103*e*, and a rear surface 103*f* opposite the front surface 103*e* along the longitudinal direction 2. Unlike the baffle plate 101, the baffle plate 103 does not include a cutout. Alternatively, the baffle plate 103 defines a height $H_3$ measured along the vertical direction 6 that is less than the height $H_2$ of the nozzle recess 132. As such, in an embodiment of the nozzle assembly 28 that includes the baffle plate 103, a passage is defined that extends from the fluid cavity 124 to the outlet passage 136 between the upper surface 103*a* of the baffle plate 103 and the upper surface 130*a* of the nozzle recess 132.

Now referring to FIGS. 9A-12, another embodiment of a nozzle assembly 28*a* according to the present disclosure will be discussed. Like the nozzle assembly 28, the nozzle assembly 28*a* can be attached to the pump 16 of the applicator system 10. The nozzle assembly 28*a* has many similar components and features as the nozzle assembly 28, which will not be discussed in detail. The nozzle assembly 28*a* can include a vertical portion 200 configured to attach to and receive material from the pump 16, an arm 204 extending from the vertical portion 200, and a nozzle head 208 attached to the arm 204 opposite the vertical portion 200. The vertical portion 200 includes an inlet port 210 for receiving the material from the pump 16. The inlet port 210 is fluidly connected to a passage 216 extending through the vertical portion 200 and the arm 204 to the nozzle head 208. A plug 244 can be configured to engage the vertical portion 200 to seal an opening to the passage 216 that can be used during periods of nonoperation for cleaning and flushing the passage 216. The arm 204 can include a check valve 207 at least partially disposed within the passage 216 for controlling the flow of material through the passage 216. Specifically, the check valve 207 is in fluid communication with the passage 216 upstream from the nozzle head 208. The check valve 207 can include a steel ball 250, a spring 254, and a nut 258. The initial pressure required to activate the check valve 207 can be adjusted through rotation of the nut 258. Though one particular check valve design is shown, the check valve 207 is not meant to be limited to such. The check valve 207 can function to allow material to flow through the passage 216 and to the nozzle head 208 when the material flows above a threshold pressure, but prevent material from flowing through the passage 216 to the nozzle head 208 when the material flows below a threshold pressure. Also, the check valve 207 can prevent the material from flowing from the nozzle head 208 back through the passage 216. The check valve 207 can be maintained in an initial closed state, but only open upon receiving a flow of material from the passage 216 having a desired pressure.

After flowing through the check valve 207, the material can flow into a transfer passage 220 that extends laterally through the nozzle head 208. Plugs 262, 266 can be configured to engage the arm 204 and the nozzle head 208 to seal access openings to the passage 216 and transfer passage 220 that can be used during periods of nonoperation for cleaning and flushing the passage 216 and transfer passage 220, respectively. After flowing through the transfer passage 220, the material can flow to a fluid cavity 228 defined by the baffle plate 201 and the nozzle head 208 through a plurality of laterally aligned channels 224. Each of the channels 224 can be substantially cylindrical, and can extend substantially along the longitudinal direction 2, though other configurations are envisioned. Though six channels 224 are depicted, the nozzle head 208 can include more or less than six channels 224 as desired. The fluid cavity 228 is partially defined by each of the nozzle head 208 and the baffle plate 201. The baffle plate 201 can include a flange 230 that extends longitudinally into the fluid cavity 228. Though the flange 230 is shown as extending substantially along the longitudinal direction 2, the flange 230 can alternatively be inclined or declined along the vertical direction 6.

After flowing into the fluid cavity 228, the material can flow upwards through the fluid cavity 228 under the pressure of material entering the fluid cavity 228, through the passage 232 defined by the baffle plate 201, and to the outlet passage 234. The passage 232 extends longitudinally through the baffle plate 201 and is positioned vertically between the upper and lower surfaces of the baffle plate 201, such that the passage 232 is solely defined by the baffle plate 201. The material then flows through the outlet passage 234 and through the outlet 240 defined between the cover plate 202 and the baffle plate 201, and onto a substrate. The cover plate 202 can be secured to the nozzle head 208 using screws 248, which can extend through the cover plate 202, the baffle plate 201, and threadingly engage the nozzle head 208. However, other means of attaching the cover plate 202 and baffle plate 201 to the nozzle head 208 are contemplated.

Conventional nozzle assemblies frequently spill excessive material during an application process due to the gravity of the material, which can lead to big ends, silk drawing, and other dispensing defects on the surface of the substrate during an application process, as well as at the end of an application process due to the continued undesired flow of material. In contrast, the nozzle assemblies 28, 28*a* of the present disclosure can prevent such unintended consequences. Due to the upward flow of material required within the nozzle heads 108, 208 due the position of the respective fluid cavities 124, 228 and passages 128, 232, material can be prevented from flowing over the baffle plates 101, 201 after the applicator system 10 ceases dispensing material. As a result, big ends, silk drawing, as well as other defects that can exist at the end of an application process can be prevented. This can lead to material pattern consistency and reduce wasted material and substrate as a result of finished products that are outside specified tolerances. Additionally, the components of the nozzle assembly 28, 28*a* can be easily assembled, cleaned, and replaced, leading to simplicity in operation and maintenance. Further, the segmented nature of the passages within the nozzle heads 108, 208 can lead to the ability to dispense amounts of the material with greater accuracy.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts, and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features, and concepts may be expressly identified herein as being inventive or forming part of an invention, such identification is not intended to be exclusive, but rather there may be inventive aspects, concepts, and features that are fully described herein without being expressly identified as such or as part of a specific invention, the scope of the inventions instead being set forth in the appended claims or the claims of related or continuing applications. Descriptions of exemplary methods or processes are not limited to inclusion of all steps as being required in all cases, nor is the order that the steps are presented to be construed as required or necessary unless expressly so stated.

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired.

What is claimed:

1. A nozzle assembly for dispensing a material, the nozzle assembly comprising:

a nozzle including a nozzle head, the nozzle head having a body that includes a side surface and a nozzle recess extending into the body from the side surface;

an arm extending downwards along a direction that is angularly offset from a vertical direction, the arm having an inlet and an outlet with a passageway therebetween, and the nozzle head is attached to the arm opposite an upper flange and the nozzle head being connected to the outlet;

a baffle plate including a cutout that extends through the baffle plate, wherein the baffle plate is received in the nozzle recess such that the nozzle head and the baffle plate define a cavity; and a cover plate attached to the nozzle head such that the cover plate secures the baffle plate within the nozzle recess, wherein an outlet passage is defined between the baffle plate and the cover plate, the outlet passage being fluidly connected to the cavity through the cutout of the baffle plate.

2. The nozzle assembly of claim 1, wherein the baffle plate has an upper surface, a lower surface opposite the upper surface along a vertical direction, a front surface, and a rear surface opposite the front surface along a longitudinal direction that is perpendicular to the vertical direction, wherein the cutout extends 1) into the baffle plate from the upper surface and 2) from the front surface to the rear surface.

3. The nozzle assembly of claim 2, wherein the front surface of the baffle plate is substantially coplanar with the side surface of the nozzle head when the baffle plate is received in the nozzle recess.

4. The nozzle assembly of claim 2, wherein the baffle plate has first and second cutout surfaces that extend from the upper surface along the vertical direction, and a third cutout surface that extends from the first cutout surface to the second cutout surface, such that the first, second, and third cutout surfaces define the cutout.

5. The nozzle assembly of claim 4, wherein the third cutout surface is positioned between the upper and lower surfaces along the vertical direction.

6. The nozzle assembly of claim 4, wherein the third cutout surface is substantially parallel to the lower surface.

7. The nozzle assembly of claim 1, wherein the nozzle recess has a first height measured along a vertical direction and the cavity has a second height measured along the vertical direction, wherein the first height is greater than the second height.

8. A nozzle assembly for dispensing a material, the nozzle assembly comprising:

a nozzle including a nozzle head, the nozzle head having a body that includes a side surface and a nozzle recess extending into the body from the side surface;

an arm extending downwards along a direction that is angularly offset from a vertical direction and the nozzle head is attached to the arm opposite an upper flange;

a baffle plate including a cutout that extends through the baffle plate, wherein the baffle plate is received in the nozzle recess such that the nozzle head and the baffle plate define a cavity;

a cover plate attached to the nozzle head such that the cover plate secures the baffle plate within the nozzle recess, wherein an outlet passage is defined between the baffle plate and the cover plate, the outlet passage being fluidly connected to the cavity through the cutout of the baffle plate;

the upper flange having an inlet for receiving the material; and the arm extending from the upper flange to the nozzle head, the arm defining a passage in fluid communication with the inlet and the cavity.

9. The nozzle assembly of claim 8, further comprising a check valve partially disposed in the passage of the arm.

10. A nozzle assembly for dispensing a material, the nozzle assembly comprising:

a nozzle including a nozzle head, the nozzle head having a body that includes a side surface and a nozzle recess extending into the body from the side surface;

an arm extending downwards along a direction that is angularly offset from a vertical direction and the nozzle head is attached to the arm opposite an upper flange;

a baffle plate including a cutout that extends through the baffle plate, wherein the baffle plate is received in the nozzle recess such that the nozzle head and the baffle plate define a cavity; and a cover plate attached to the nozzle head such that the cover plate secures the baffle plate within the nozzle recess, wherein an outlet passage is defined between the baffle plate and the cover plate, the outlet passage being fluidly connected to the cavity through the cutout of the baffle plate, wherein the cover plate defines a front surface, a rear surface opposite the front surface along a longitudinal direction, and an outlet recess that extends into the cover plate from the rear surface, wherein the outlet recess at least partially defines the outlet passage.

11. The nozzle assembly of claim 1, wherein the cover plate includes a first extension that extends downward in a vertical direction from the cover plate adjacent an outlet of the nozzle assembly.

12. The nozzle assembly of claim 11, wherein the nozzle head includes a second extension that extends downward along the vertical direction adjacent the outlet.

13. The nozzle assembly of claim 1, wherein the baffle plate comprises an aluminum alloy.

14. A nozzle assembly for dispensing a material, the nozzle assembly comprising:

a nozzle including a nozzle head, the nozzle head having a body that includes a side surface and a nozzle recess extending into the body from the side surface;

an arm extending downwards along a direction that is angularly offset from a vertical direction and the nozzle head is attached to the arm opposite an upper flange;

a baffle plate including a cutout that extends through the baffle plate, wherein the baffle plate is received in the nozzle recess such that the nozzle head and the baffle plate define a cavity; and a cover plate attached to the nozzle head such that the cover plate secures the baffle plate within the nozzle recess, wherein an outlet passage is defined between the baffle plate and the cover plate, the outlet passage being fluidly connected to the cavity through the cutout of the baffle plate, wherein the baffle plate includes a flange extending into the cavity.

15. The nozzle assembly of claim 1, wherein the nozzle head includes a plurality of laterally aligned channels that extend from a transfer passage defined by the nozzle head to the cavity.

16. The nozzle assembly of claim 1, wherein the baffle plate has an upper surface, a lower surface opposite the upper surface along a vertical direction, a front surface, and a rear surface opposite the front surface along a longitudinal direction that is perpendicular to the vertical direction, wherein the cutout extends from the front surface to the rear surface between the upper and lower surfaces.

* * * * *